US007854233B2

(12) United States Patent
Freelove

(10) Patent No.: US 7,854,233 B2
(45) Date of Patent: Dec. 21, 2010

(54) HAIR EXTENSION DEVICE

(76) Inventor: Michelle Freelove, 1584 Route 79, Windsor, NY (US) 13865

( * ) Notice: Subject to any disclaimer, the term of this patent is extended or adjusted under 35 U.S.C. 154(b) by 690 days.

(21) Appl. No.: 11/791,921

(22) PCT Filed: Jan. 31, 2006

(86) PCT No.: PCT/US2006/003283

§ 371 (c)(1),
(2), (4) Date: May 30, 2007

(87) PCT Pub. No.: WO2006/083790

PCT Pub. Date: Aug. 10, 2006

(65) Prior Publication Data

US 2008/0072920 A1 Mar. 27, 2008

Related U.S. Application Data

(60) Provisional application No. 60/647,781, filed on Jan. 31, 2005.

(51) Int. Cl.
*A41G 3/00* (2006.01)

(52) U.S. Cl. ..... 132/201; 123/53

(58) Field of Classification Search ..... 132/201, 132/53–56

See application file for complete search history.

(56) References Cited

U.S. PATENT DOCUMENTS

| | | | | | |
|---|---|---|---|---|---|
| 59,261 | A | * | 10/1866 | Muller | 248/406.1 |
| 1,351,427 | A | | 8/1920 | Krasmauskis | |
| 1,424,845 | A | | 8/1922 | Nolan | |
| 1,607,926 | A | | 11/1926 | Sterling | |
| 1,634,190 | A | * | 6/1927 | Hepner | 132/53 |
| 1,638,016 | A | | 8/1927 | Oppenheim | |
| 2,621,663 | A | | 12/1952 | Jenkins | |
| 2,865,380 | A | | 12/1958 | Mitchell | |
| 3,280,826 | A | * | 10/1966 | Jenkins | 132/201 |
| 4,600,029 | A | * | 7/1986 | Ueberschaar | 132/53 |
| 5,551,452 | A | * | 9/1996 | Barlow | 132/54 |
| 6,830,054 | B1 | * | 12/2004 | Ross-Kuehn | 132/201 |
| 2005/0268928 | A1 | * | 12/2005 | Lane | 132/53 |

* cited by examiner

*Primary Examiner*—Rachel R Steitz
(74) *Attorney, Agent, or Firm*—Hogan Lovells US LLP

(57) ABSTRACT

A hair extension device that allows a user to add supplemental, natural, human hair strands to the natural hair of the user. The hair extension device includes a filament formed into a circular or oval shape to encircle the head. Hair weft lengths are attached to the filament along an arcuate length of the filament. When the device is positioned on the head, the hair strands of the hair weft lengths extend down the sides and back of the user. The natural hair held beneath the filament is pulled up and forward, then backward over the filament, blending together the natural hair of the user and the supplemental hair strands.

4 Claims, 5 Drawing Sheets

HAIR EXTENSION DEVICE

RELATED APPLICATION

The present patent application claims the benefit of priority to U.S. provisional patent application Ser. No. 60/647,781, filed Jan. 31, 2005, the priority of which is hereby claimed.

FIELD OF THE INVENTION

The present invention relates to hair extension devices, and more particularly to a clipless and non-adhesive hair extension device.

BACKGROUND OF THE INVENTION

One of the most attractive features of people, especially women, has always been their hair. This fact has been known for thousands of years, which explains certain religious sects' edict to cover or even cut women's hair. For those women who are unaffected by such restrictions, however, long, luxurious human hair is an asset that results in improved appearance and self esteem. Unfortunately, due to age, disease or genetics, not everyone is fortunate enough to have a full complement of natural hair. For those, hair pieces and wigs are often the answer.

Numerous methods and devices for creating the appearance of thicker or longer hair exist in the prior art. When adding supplemental natural or synthetic hair to that of an individual, the typical method involves applying the supplemental hair directly to the individual's natural hair, either by gluing the strands of hair to the natural hair or by bonding strands of the supplemental hair to the natural hair using a durable bonding material. Applying additional hair strands to an individual's natural hair is a meticulous process that requires hours of application time. Additionally, after time, the supplemental hair strands tend to unravel or fall out. More supplemental hair must be reapplied or the supplemental strands must be removed, often causing a great deal of damage to the individual's natural hair.

An alternate method of providing hair extensions for a user involves adding to an individual's natural hair by using hair clips to attach strands of supplemental hair to the user's natural hair. While this method is effective in providing the appearance of longer or thicker hair for the user, the addition of hair clips tends to be quite cumbersome during use. The user cannot easily wash her natural or supplemental hair with the hair clips in the hair. Moreover, adding hair clips to the hair involves excessive time.

DESCRIPTION OF THE RELATED ART

Hair extension devices exist that do not require the use of hair clips, gluing, bonding or other intrusive methods of adding supplemental hair to natural hair.

U.S. Pat. No. 1,351,427, issued Aug. 31, 1920 to Veronika Krasmauskis, describes a hair-dressing attachment for forming artificial side or ear puffs. The article consists of two switches of hair connected together by a cord or wire crossed over the head to support the switches at the side of the head so that, when the puffs are formed up from the switches, they will be in the proper position.

U.S. Pat. No. 1,424,845, issued Aug. 8, 1922 to William E. Nolan, describes transformations or wigs of the long-hair type that are worn principally by women and in contra-distinction to toupees and to other hair-dress devices employing permanently-bobbed or other set styles of hair.

U.S. Pat. No. 1,607,926, issued Nov. 23, 1926 to Bernard A. Sterling, describes a hairdressing attachment for use at the back of the head to conceal a bob and give hair that has been bobbed an unbobbed appearance. The structure may be secured in place upon the head with means for locking the attachment positively and firmly in place and against accidental displacement.

U.S. Pat. No. 1,638,016, issued Aug. 9, 1927 to Jesse Oppenheim, describes hair dressing appliances and devices employed for the attachment of hair pieces to bobbed hair so that the wearer will present, for dress or other purposes, the appearance of having long hair which may be dressed or manipulated in any desired style.

U.S. Pat. No. 2,865,380, issued Dec. 23, 1958 to Princess Mitchell, describes hairpieces and methods of hair preparation whereby a short hair dress may be rapidly converted into a long hair dress.

U.S. Pat. No. 3,280,826, issued Oct. 25, 1966 to Christina M. Jenkins, describes a hair piece composed of commercial or false hair adapted to be applied to the human head by securing the same to existing live hair.

U.S. Pat. No. 2,621,663, issued to Christina M. Jenkins, contemplates mounting on the head a base of attachment for the commercial hair by interweaving strands of live hair with a base material and then attaching a switch, weft or like accessory of commercial hair to the base. With this method, the commercial hair is permanently attached to the live hair and serves to give the live hair the appearance of greater length and thickness as well as cover bald spots, thin spots, or scars.

U.S. Pat. No. 4,600,029, issued Jul. 15, 1986 to Ueberschaar, describes a hairpiece having individual hairs adjustably secured about a circular filament. The hairpiece is then placed on the user's head, the filament sandwiched beneath an upper layer and above an underlying layer of hair on the head, so the natural hair of the user is blended with the supplemental hair on the hairpiece. Each hair is individually applied to the filament, requiring a tedious, inordinately complicated process in assembling the hairpiece. Additionally, as each hair is added to the filament individually, only a single row of individual hair strands may be attached to the filament, thereby limiting the amount of hair that is attachable to the hairpiece. As such, the thickness of the supplemental hair is restricted to the level of a single row of individual hair strands.

Therefore, there is a need for a hair extension device that avoids or eliminates the use of hair clips, glue or bonding material but provides a quick and efficient method of adding supplemental hair to a user's natural hair. Moreover, there is a need for a device that provides numerous layers of supplemental hair strands, such that the supplemental hair provided for the user may have varying levels of thickness and length.

It is an object of the invention therefore to provide a hairpiece that may be sandwiched between layers of natural hair and be invisible to an observer and supply additional volume and length of hair to the head.

A further object of the present invention is to provide means whereby the circular filament, if traversing a part line, will be virtually invisible in its crossing.

Another object of the invention is to provide means whereby the hair may be massed or distributed in lesser or greater amounts depending upon the desired hair style or problem of the wearer.

A still further object of the invention is to provide means whereby additional segments of hair may be secured as may be desired.

Another object of the invention is to provide a hairpiece of the type described which may be used as a "ponytail" or the like, or as a "bun".

A still further object of the invention is to provide means whereby the additional hairpiece may be sandwiched between layers of natural hair so that the frictional relationship of the added hairpiece on the natural hair and the fixed roots of the lapping natural hair anchors the same in the adjusted place position and the hair, with its sandwiched hairpiece in place, may be shampooed, wet, as in swimming without dislodgement of the hairpiece.

Another object of the invention is to provide means whereby hair of contrasting shades on the hairpiece may be used wherefore the effect of "streaking" in the hair is secured, if desired, without the need to bleach or color the natural hair.

SUMMARY OF THE INVENTION

In accordance with the present invention, there is provided a hair extension device that allows a user to create the appearance of having additional amounts of hair without the need for: gluing hair extensions to the natural hair of the user; using supplemental hair clips; or gluing the device onto the scalp of the user. The hair extension device includes a durable filament formed into a circular or oval shape set on the user's head and encircling the head. Hair weft lengths are first sewn to one another in a direction substantially perpendicular to the major axis thereof. The weft lengths are generally affixed to the filament by laying the filament at a predetermined position along the major axis of the weft lengths, proximate the sewn position of the weft lengths, and then folded over and either sewn or glued and sewn in place proximate an arcuate section thereof.

The hair extension device is set upon the head of a user, with the portion of the filament having the hair weft lengths attached being positioned on the lower portion of the user's head, covering the sides and back thereof. The section of the filament that is not covered with the hair weft lengths is situated on the crown of the user and extends down the head near the ears of the user. When the device is properly positioned, supplemental hair strands of the hair weft lengths extend down past the user's natural hair.

The hair of the user that is held beneath the filament is pulled forward by the user, simply by running the user's fingers through the user's natural hair and pulling the hair up and then backward over the filament. The user's natural hair therefore covers the filament and blends with the supplemental hair strands extending off of the filament.

The strength of the filament and the weight of the hair weft lengths allow the hair extension device to be set upon and maintained on the head of the user without the need for additional securing measures. The hair extension device does not require use of clips or glue in order to stabilize the device to the user's head.

BRIEF DESCRIPTION OF THE DRAWINGS

A complete understanding of the present invention may be obtained by reference to the accompanying drawing, when taken in conjunction with the detail description thereof and in which.

DETAILED DESCRIPTION OF THE PREFERRED EMBODIMENT

The present invention is a hair extension device that is releasably attached to the head of a user and allows the user to create the appearance of having additional hair. The extension device is designed to affix to the head of a user without the need for gluing hair extensions to the natural hair, gluing the device onto the scalp of the user or attaching the device using supplemental hair clips.

Figure 1:
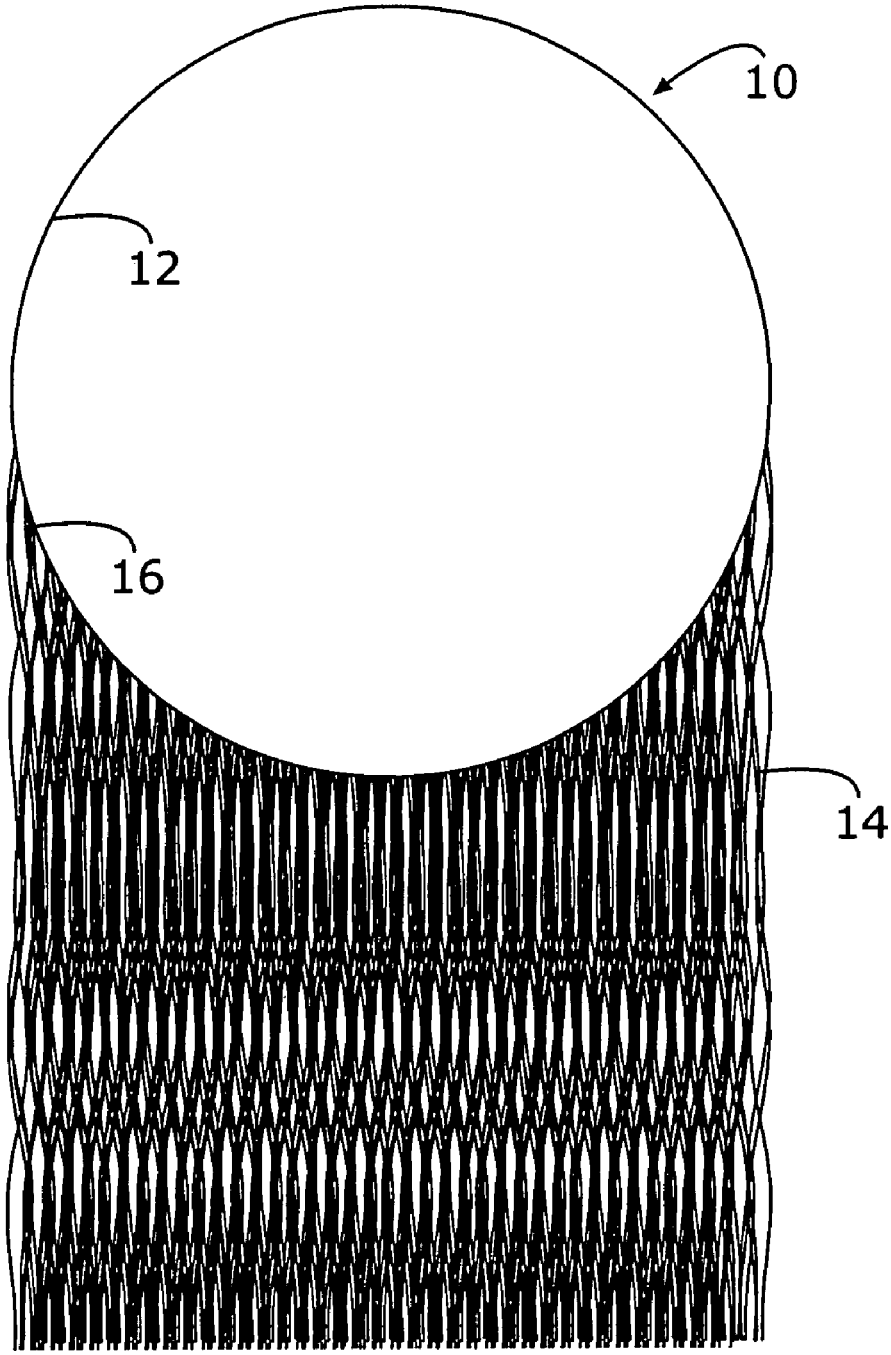
FIG. 1 is a plan view of a hair extension device according to the present invention.

FIG. 1 shows a plan perspective view of the hair extension device 10, which includes a durable filament 12 to which a plurality of hair weft lengths 16 is attached as a first continuous portion (the remainder of the filament is a section continuous portion). The hair weft lengths 16 are made with a plurality of supplemental, natural or artificial hair strands 14 that are bound together along the widths thereof to create the weft lengths 16. The hair strands 14 are generally arranged in a parallel manner with each other and bound at one-quarter to one-half of the lengths of each of the strands 14 to form the hair weft lengths 16.

The filament 12 is formed into a circular or oval shape, so that the filament 12 can be set upon and encircle the head 13 of a user. The hair weft lengths 16 are affixed along an arcuate section of approximately half of the circular filament 12. The hair weft lengths 16 are attached to approximately half of the circumference of the filament 12, but may be attached to more or less than half of the filament 12 the remainder of the filament containing no hair wefts. It should also be understood that, in an alternate embodiment, suitable glue or adhesive may be used to attach hair weft lengths 16 to one another upon folding over filament 12.

The hair weft lengths 16 are made from natural, human hair strands 14, which are preferably natural but may be synthetic hair of varying lengths, colors, diameters, and textures suitable for supplementing a user's natural hair. The filament 12 may be made from Nylon, polyethylene, Dacron or any other type of durable material including but not limited to fishing line.

Figure 2:
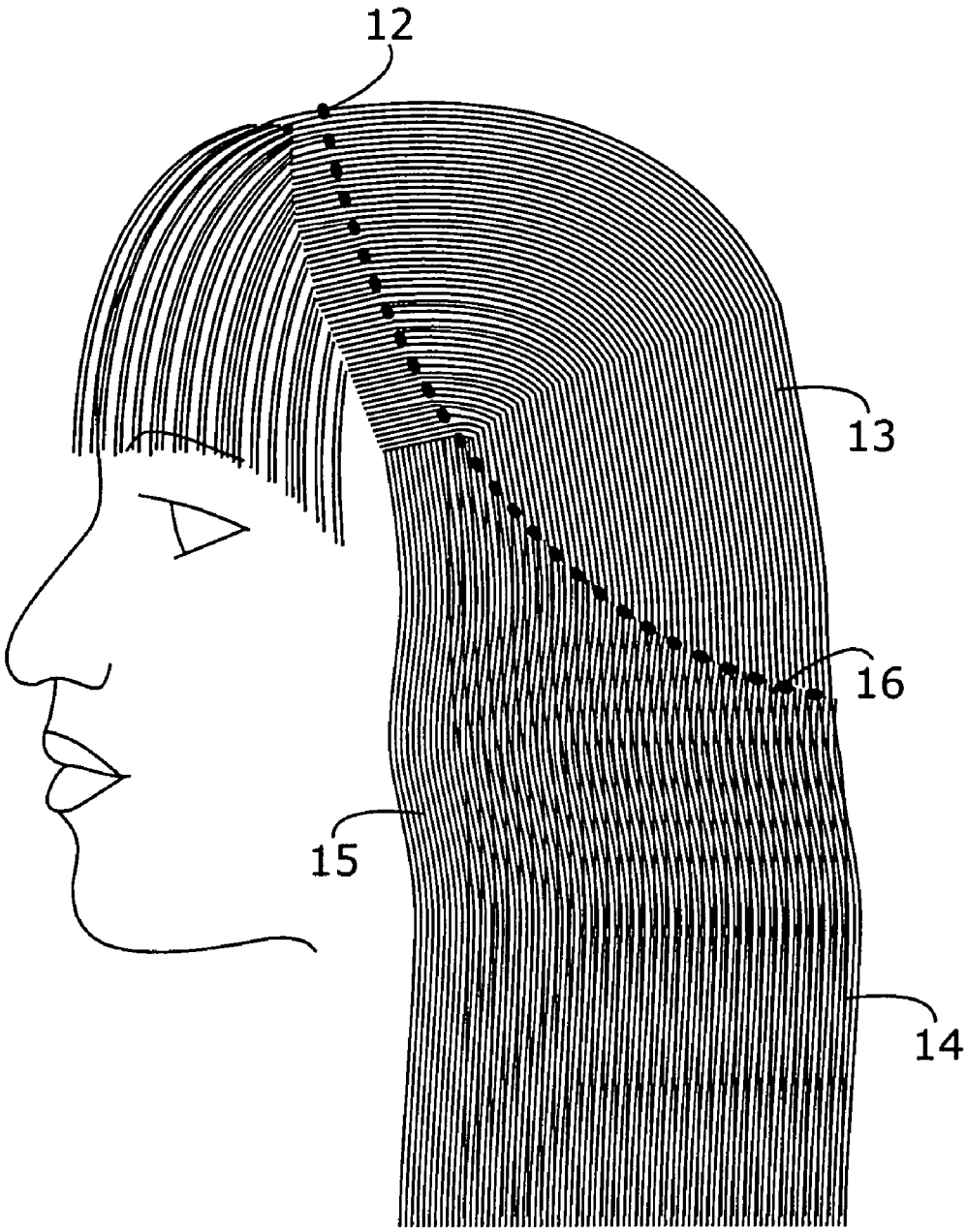
FIG. 2 is an in situ, perspective view of the hair extension device with the hair of the user placed over the device.

Referring now to FIG. 2, the filament 12 is set on top of the user's natural hair 15 and encircles the user's head 13. The circular filament 12 is placed on the head 13 such that the section of the filament 12 with hair weft lengths 16 attached is positioned on the lower portion of the head 13. The remainder of the filament 12 is positioned on the crown of the head 13. The hair strands 14 of the hair weft lengths 16 extend down past the user's natural hair 15 along the back and sides of the user.

The hair 15 of the user that is held beneath the filament 12 is pulled up and over the filament 12 so that the filament 12 is invisible. The user generally simply runs the user's fingers through the user's natural hair 15 and pulls the hair up and then backward over the filament 12. The user's natural hair 15 therefore covers the filament 12 and blends with the supplemental hair strands 14 extending off of the filament 12.

The strength and rigidity of the filament 12 and the weight of the hair weft lengths 16 allows the hair extension device 10 to be set upon and maintained on the head 13 of the user without the need for any additional securing measures. The hair extension device 10 does not require use of clips or glue in order to stabilize the device 10 to the user's head.

Figure 3A:
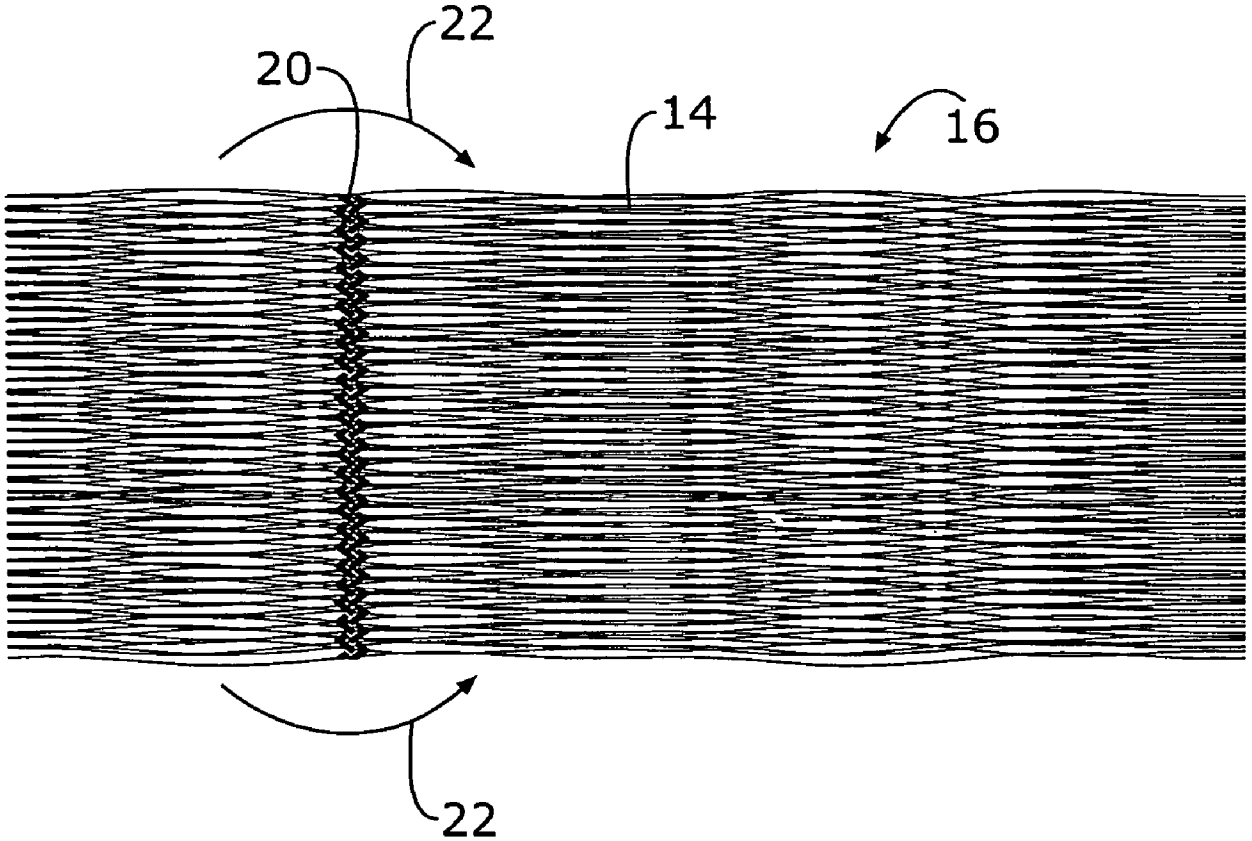
FIGS. 3*a*-3*c* illustrate the process of affixing natural and artificial hair to the filament of the inventive hair extension device.
Figure 3B:
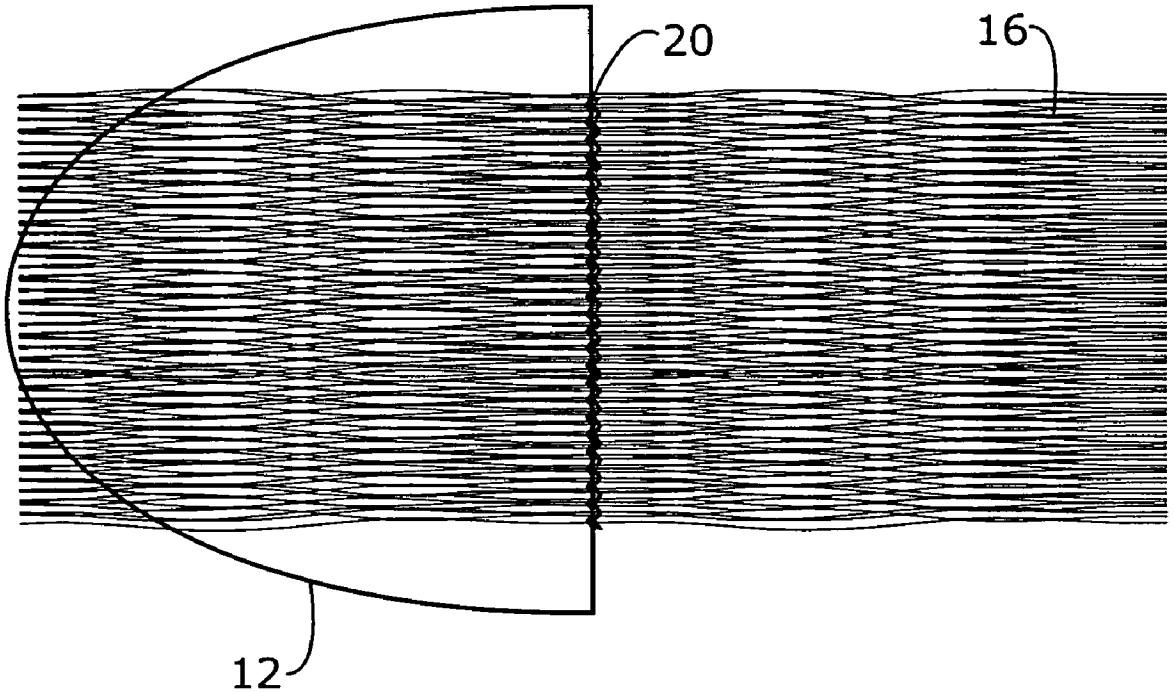
Figure 3C:
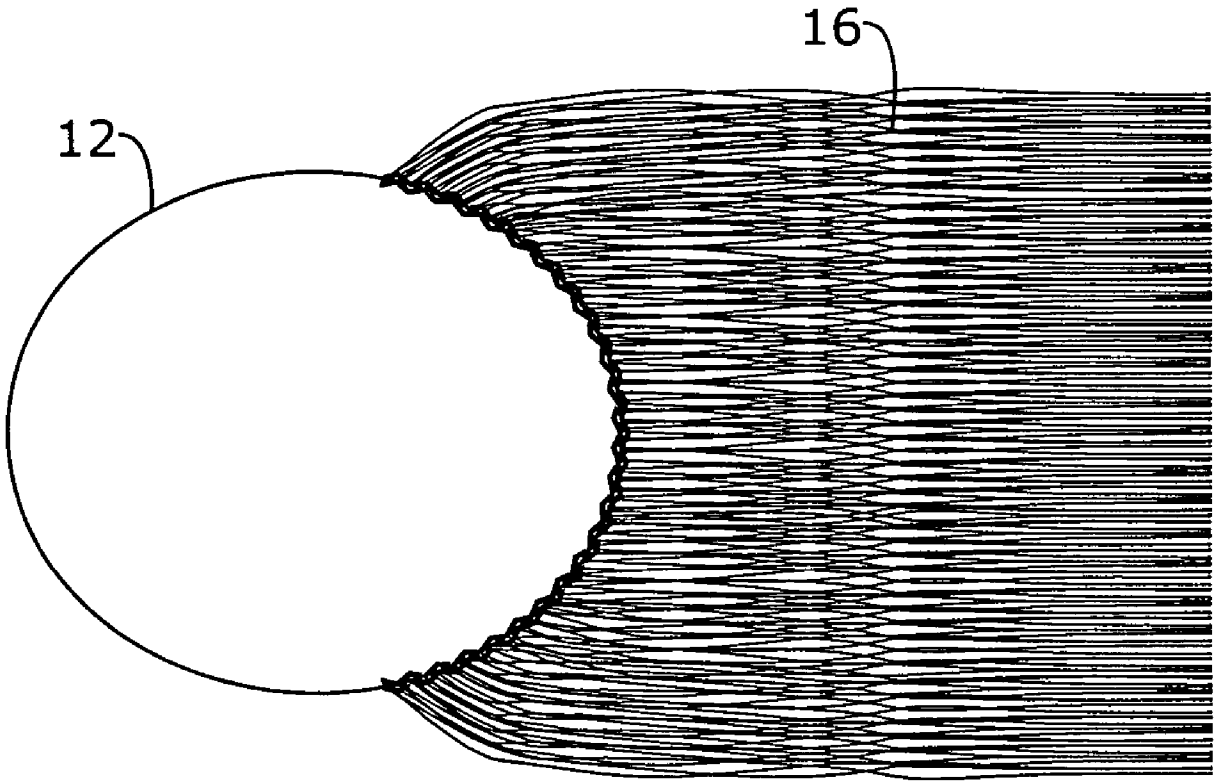

Referring now to FIGS. 3*a*-3*c*, a plurality of hair weft lengths 16 is sewn together at one-quarter to one-half the length of strands 14 in parallel in order to combine multiple layers of hair strands 14 into a single composite weft length 16 (FIG. 3*a*). Once the lengths 16 are sewn together with thread 20, the lengths 16 are then folded open with approximately between one-quarter and one-half of the hair strands 14 on one side and the remainder of the hair strands 14 on the other side.

Referring now to FIG. 3*b*, filament 12 is laid on top of the sewn portion 15 of lengths 16. The lengths 16 are then folded over the filament 12, sandwiching filament 12, and finally sewn via thread 20 and/or sewn and glued, so that the filament 12 is maintained between the top, bound portions of the hair weft lengths 16. The hair weft lengths 16 are bound to at least half of an arcuate length of the circumference of the filament 12 in the preferred embodiment. Although one method of securing the hair weft lengths 16 to the filament 12 is described, the hair weft lengths 16 may be sewn to the filament in any manner consistent with maintaining the hair weft lengths 16 to approximately at least half of an arcuate section of the filament 12.

The hair weft lengths 16 are then folded (arrows 22, FIG. 3*a*), and again sewn together via thread 20. The final device 10 has the arcuate portion of filament 12 attached to weft lengths 16, as shown in FIG. 3*c*.

Since other modifications and changes varied to fit particular operating requirements and environments will be apparent to those skilled in the art, the invention is not considered limited to the examples chosen for purposes of disclosure, and covers all changes and modifications which do not constitute departures from the true spirit and scope of this invention.

Having thus described the invention, what is desired to be protected by Letters Patent is presented in the subsequently appended claims.

What is claimed is:

1. A reusable hair extension device for attachment to the head of a user, comprising: a flexible and durable filament having an oval, elliptical, or circular cross section; said filament having a length forming a loop for encircling at least a portion of the user's head; said filament having:

a first continuous portion containing an entire length and a plurality of hair wefts attached to and extending along the entire length of the first continuous portion; said plurality of hair wefts each containing lengths of hair;

a second continuous portion containing a length, wherein no hair wefts are attached to the second continuous portion;

the hair wefts are sewn together forming a single composite weft;

the filament is laid on top of the composite weft; and the lengths of hair composing the composite weft are folded over the filament, thereby sandwiching the filament between the lengths of hair.

2. The hair extension device of claim 1 wherein the folded over composite weft is sewn shut, thereby binding the filament within a top portion of the lengths of hair.

3. A reusable hair extension device for attachment to the head of a user, said device being formed by a process containing the following steps:

providing a flexible and durable filament having an oval, elliptical, or circular cross section; said filament having a length forming a loop for encircling at least a portion of the user's head;

forming a first continuous portion in the filament; said portion containing an entire length;

attaching a plurality of hair wefts along the entire length of the first continuous portion; said plurality of hair wefts each containing lengths of hair;

forming a second continuous portion containing a length, wherein no hair wefts are attached to the second continuous portion;

sewing the hair wefts together to form a single composite weft;

placing the filament on top of the composite weft;

folding the lengths of hair composing the composite weft over the filament, thereby sandwiching the filament between the lengths of hair.

4. The process of claim 3 comprising the step of sewing the composite weft shut, thereby binding the filament within a top portion of the lengths of hair.

* * * * *